US008689809B2

(12) United States Patent
Curry et al.

(10) Patent No.: US 8,689,809 B2
(45) Date of Patent: Apr. 8, 2014

(54) COSMETIC COLOR APPLICATOR AND METHOD FOR USING SAME

(71) Applicant: Edison Nation, LLC, Charlotte, NC (US)

(72) Inventors: Anna Curry, Charlotte, NC (US); Juan Carlos Perez, Charlotte, NC (US); Raeshon Lamont McNeil, Charlotte, NC (US); Jeff Browning, Charlotte, NC (US); Alexa Adams, Matthews, NC (US); Daniel Lee Bizzell, Charlotte, NC (US); Daniel Cordero, Charlotte, NC (US); Todd Stancombe, Charlotte, NC (US); Robert Roger Hall, Winston-Salem, NC (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

(21) Appl. No.: 13/682,659

(22) Filed: Nov. 20, 2012

(65) Prior Publication Data

US 2014/0048095 A1 Feb. 20, 2014

Related U.S. Application Data

(60) Provisional application No. 61/684,750, filed on Aug. 18, 2012.

(51) Int. Cl.
*A45D 19/00* (2006.01)

(52) U.S. Cl.
USPC ..... 132/270; 132/221; 401/10

(58) Field of Classification Search
USPC ..... 132/202, 207, 208, 212, 270, 317, 320, 132/221; 401/10; 434/98–100; 15/104.93, 15/104.94, 210.1, 214, 220.3, 220.4, 218, 15/218.1
See application file for complete search history.

(56) References Cited

U.S. PATENT DOCUMENTS

| | | | | | |
|---|---|---|---|---|---|
| 418,707 | A | * | 1/1890 | Ely | 15/214 |
| 1,059,440 | A | * | 4/1913 | Cochrane | 15/214 |
| 1,712,325 | A | * | 5/1929 | Brandfon | 15/214 |
| 2,242,134 | A | * | 5/1941 | Percy | 15/104.5 |
| D324,497 | S | | 3/1992 | Denton | |
| 5,704,088 | A | * | 1/1998 | Cerroni | 15/160 |
| D439,376 | S | | 3/2001 | Lerolle | |
| D523,750 | S | | 6/2006 | Lee et al. | |
| D525,748 | S | | 7/2006 | Colne | |
| D530,860 | S | | 10/2006 | Funkhouser et al. | |
| D595,899 | S | | 7/2009 | Krause-Neufeldt | |
| D645,616 | S | | 9/2011 | Wells | |

(Continued)

*Primary Examiner* — Robyn Doan
*Assistant Examiner* — Tatiana Nobrega
(74) *Attorney, Agent, or Firm* — Tillman Wright, PLLC; James D. Wright; David R. Higgins

(57) ABSTRACT

A cosmetic applicator for highlighting or imparting color to a user's hair includes upper and lower halves attached together by a hinge. Each half includes a rigid outer cap and a flexible connector surrounding and connecting the outer cap to a perimeter of the respective half. The cosmetic applicator further includes an applicator pad arranged in an interior of one of the upper and lower halves and a coloring material arranged in an interior of the other of the upper and lower halves. The flexible connector permits the outer caps of the respective upper and lower halves to be pressed inwardly toward one another so as to bring the applicator pad and the coloring material into engagement with one another.

19 Claims, 11 Drawing Sheets

(56) References Cited

U.S. PATENT DOCUMENTS

| | | | | |
|---|---|---|---|---|
| D681,877 | S * | 5/2013 | Curry et al. | D28/7 |
| 8,499,770 | B2 * | 8/2013 | Smith | 132/270 |
| 2008/0083419 | A1 * | 4/2008 | Glenn et al. | 132/208 |
| 2008/0083420 | A1 * | 4/2008 | Glenn et al. | 132/208 |
| 2008/0087294 | A1 * | 4/2008 | Glenn et al. | 132/221 |
| 2009/0050171 | A1 * | 2/2009 | Barrass et al. | 132/208 |
| 2009/0071496 | A1 | 3/2009 | Glenn et al. | |
| 2009/0084394 | A1 * | 4/2009 | Baker et al. | 132/208 |
| 2009/0084395 | A1 * | 4/2009 | Glenn et al. | 132/208 |
| 2009/0095314 | A1 * | 4/2009 | Lund et al. | 132/208 |
| 2010/0101595 | A1 | 4/2010 | Glenn et al. | |
| 2010/0139683 | A1 * | 6/2010 | Smith | 132/208 |
| 2010/0175704 | A1 * | 7/2010 | Gueret | 132/200 |

* cited by examiner

COSMETIC COLOR APPLICATOR AND METHOD FOR USING SAME

CROSS REFERENCE TO RELATED APPLICATIONS

The present application is a U.S. non-provisional patent application of, and claims priority under 35 U.S.C. §119(e) to, U.S. provisional patent application Ser. No. 61/684,750, filed Aug. 18, 2012, which is expressly incorporated by reference herein in its entirety, and a copy of which is contained in Appendix A, attached hereto and likewise expressly incorporated by reference herein in its entirety.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND

1. Field

The present invention relates generally to cosmetic applicators, and, in particular, to a cosmetic applicator for use in highlighting or imparting color to a user's hair.

2. Background

Hair coloration has long been a popular activity for children and teenagers alike. The ability to add a splash of color to one's hair can be a way for a child to express his or her creativity and can be particularly useful for children's costume parties. Furthermore, teenagers and young adults often use distinct and sometimes prominent hair colors to express their individuality or to stand out from a crowd. Further still, theater and musical groups often use unique hair coloration as part of their costuming for theatrical productions.

Many hair coloration products used today can be difficult to apply or may be very difficult to wash out once no longer desired or needed.

Accordingly a need exists for a cosmetic color applicator capable of imparting color to a user's hair in an easy manner and in such a way that the color can be easily removed when no longer desired or needed. These, and other needs, are addressed by one or more aspects of the present invention.

SUMMARY

The present invention comprises a cosmetic applicator for highlighting or imparting color to a user's hair. Broadly defined, the present invention according to a first aspect includes a cosmetic applicator for highlighting or imparting color to a user's hair that includes upper and lower halves attached together by a hinge. Each half includes a rigid outer cap and a flexible connector surrounding and connecting the outer cap to a perimeter of the respective half. The color applicator further includes an applicator pad arranged in an interior of one of the upper and lower halves and a coloring material arranged in an interior of the other of the upper and lower halves. The flexible connector permits the outer caps of the respective upper and lower halves to be pressed inwardly toward one another so as to bring the applicator pad and the coloring material into engagement with one another.

In features of this aspect, the coloring material may include a chalk material; the applicator pad may be a sponge; the coloring material may include at least one of the following colors: green, pink, fuchsia, red, blue and cyan; and the color of the flexible connectors may be color-coded with the color of the coloring material.

In further features of this aspect, one of the upper and lower halves may include a hooked portion to claspingly engage with an edge of the other of the upper and lower halves, thereby facilitating clasping of the upper and lower halves together; and the hinge may include a spring for biasing the upper and lower halves against arrangement in a closed configuration such that, when unclasped, the upper and lower halves spring apart.

Broadly defined, the present invention according to a second aspect includes a cosmetic applicator substantially as shown and described.

Broadly defined, the present invention according to a third aspect includes a cosmetic applicator for highlighting or imparting color to a user's hair, substantially as shown and described.

Broadly defined, the present invention according to a fourth aspect includes a kit for coloring hair. The kit includes one or more color applicators and a tray for housing the one or more color applicators. Each color applicator includes upper and lower halves attached together by a hinge. Each of the upper and lower halves includes a rigid outer cap and a flexible connector surrounding and connecting the outer cap to a perimeter of the respective half.

In features of this aspect, each color applicator may include an applicator pad arranged in an interior of one of the upper and lower halves and a coloring material arranged in an interior of the other of the upper and lower halves, wherein the flexible connector permits the outer caps of the respective upper and lower halves to be pressed inwardly toward one another so as to bring the applicator pad and the coloring material into engagement with one another; the coloring material of each of the one or more color applicators may include a chalk material; the applicator pad of each of the one or more color applicators may be a sponge; and the color of the flexible connectors of each of the one or more color applicators may be color-coded with the color of the coloring material contained within each of the one or more color applicators.

In a further feature of this aspect, the one or more color applicators may include a plurality of color applicators, each having a coloring material of a different color.

In still further features of this aspect, one of the upper and lower halves may include a hooked portion to claspingly engage with an edge of the other of the upper and lower halves, thereby facilitating clasping of the upper and lower halves together; and the hinge may include a spring for biasing the upper and lower halves against arrangement in a closed configuration such that, when unclasped, the upper and lower halves spring apart.

In still further features of this aspect, the kit may further include a lid for covering the tray; and the lid may be transparent to permit viewing of the contents of the tray.

In still further features of this aspect, the tray may include a plurality of wells, each well being sized to surround one of the one or more color applicators; each well may be sized to snugly retain one of the one or more color applicators; and the tray may include eight wells.

In still further features of this aspect, the tray may be formed of a rigid plastic material; and the tray may include a central reservoir for containing a liquid substance for washing applicator pads of the one or more color applicators.

Broadly defined, the present invention according to a fifth aspect includes a kit for coloring hair, substantially as shown and described.

Broadly defined, the present invention according to a sixth aspect includes a tray for housing one or more color applicators, substantially as shown and described.

Broadly defined, the present invention according to a seventh aspect includes a method of applying color to a user's hair. The method includes: providing a color applicator having upper and lower halves attached together by a hinge; placing a plurality of strands of a user's hair between the upper and lower halves; and compressing the upper and lower halves toward one another, thereby clamping the plurality of strands of a user's hair between an applicator pad arranged in an interior of one of the upper and lower halves and a coloring material arranged in an interior of the other of the upper and lower halves.

In features of this aspect, the method may further include pulling the color applicator along the plurality of strands of a user's hair clamped between the upper and lower halves, thereby imparting the color of the coloring material to the plurality of strands of a user's hair; and the method may further include clasping a hooked portion of one of the upper and lower halves against an edge of the other of the upper and lower halves, thereby facilitating clasping of the upper and lower halves together.

In further features of this aspect, each of the upper and lower halves of the color applicator may include a rigid outer cap and a flexible connector surrounding and connecting the outer cap to a perimeter of the respective half, thereby facilitating resilient compression of the upper and lower halves toward one another to clamp the plurality of strands of a user's hair; the coloring material may include a chalk material; and the applicator pad may be a sponge.

Broadly defined, the present invention according to an eighth aspect includes a method of using a color applicator substantially as shown and described.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
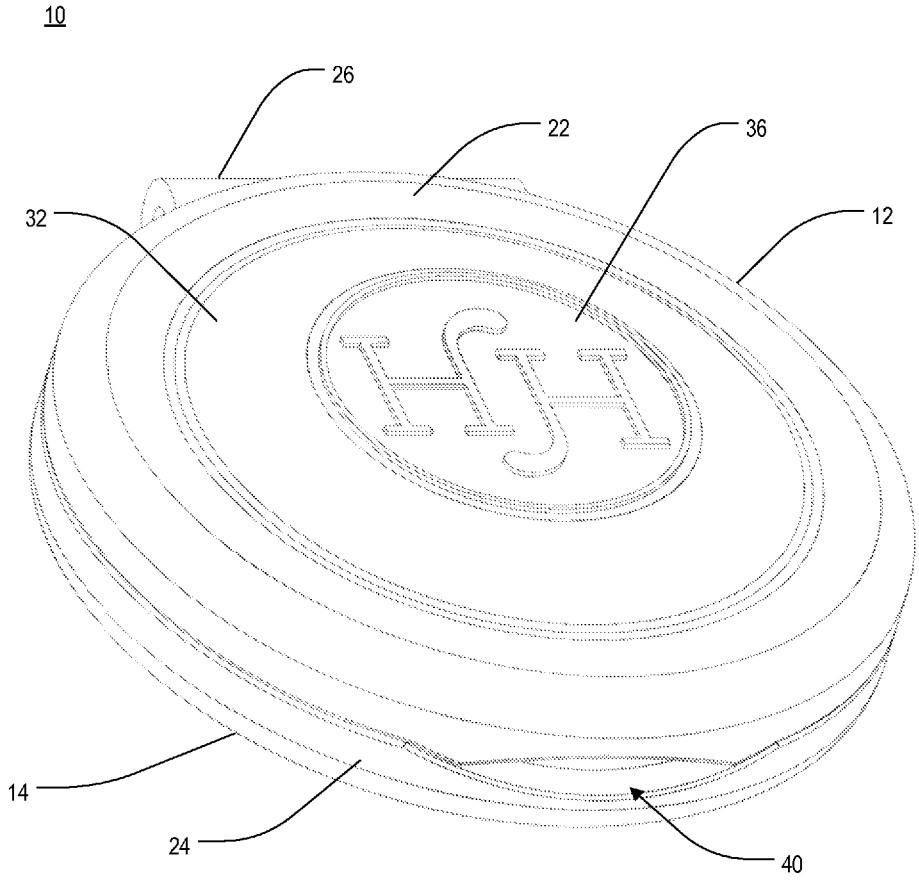
FIG. 1 is a top perspective view of a color applicator in accordance with one or more embodiments of the present invention, shown in a closed configuration.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, the preferred embodiments of the present invention are next described. The following description of one or more preferred embodiment(s) is merely exemplary in nature and is in no way intended to limit the invention, its application, or uses.

FIG. 1 is a top perspective view of a color applicator 10 in accordance with one or more embodiments of the present invention, shown in a closed configuration. As shown in FIG. 1, the color applicator 10 includes upper and lower halves 12,14 attached together by a hinge 26. The hinge 26 attaches to each half 12,14 of the color applicator 10 along a portion of an edge of each half 12,14. Positioned at an edge opposite of the hinge 26 is a gap 40 between the upper and lower halves 12,14. The gap 40 permits a user to unclasp the upper and lower halves 12,14 from one another and open the color applicator 10 about the hinge 26, as will be explained in greater detail below.

The outer perimeter 22,24 of each of the upper and lower halves 12,14 is formed of a generally rigid plastic material. Each of the upper and lower halves 12,14 has the general shape of an inward-facing shell such that, when the color applicator 10 is in a closed configuration (such as in FIG. 1), the upper and lower halves 12,14 define a closed clamshell shape having a hollow interior. In one contemplated embodiment, the color applicator 10 has a length of about 2 inches and a height of about 1 inch.

Figure 2:
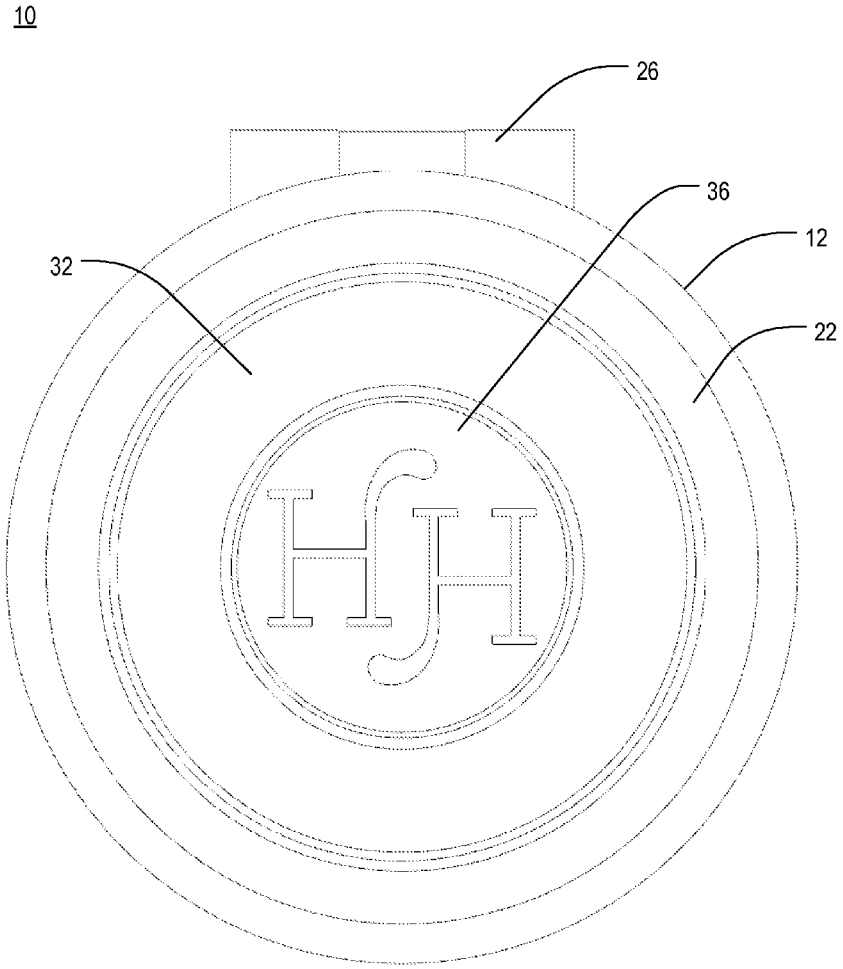
FIG. 2 is a top view of the color applicator of FIG. 1.
Figure 3:
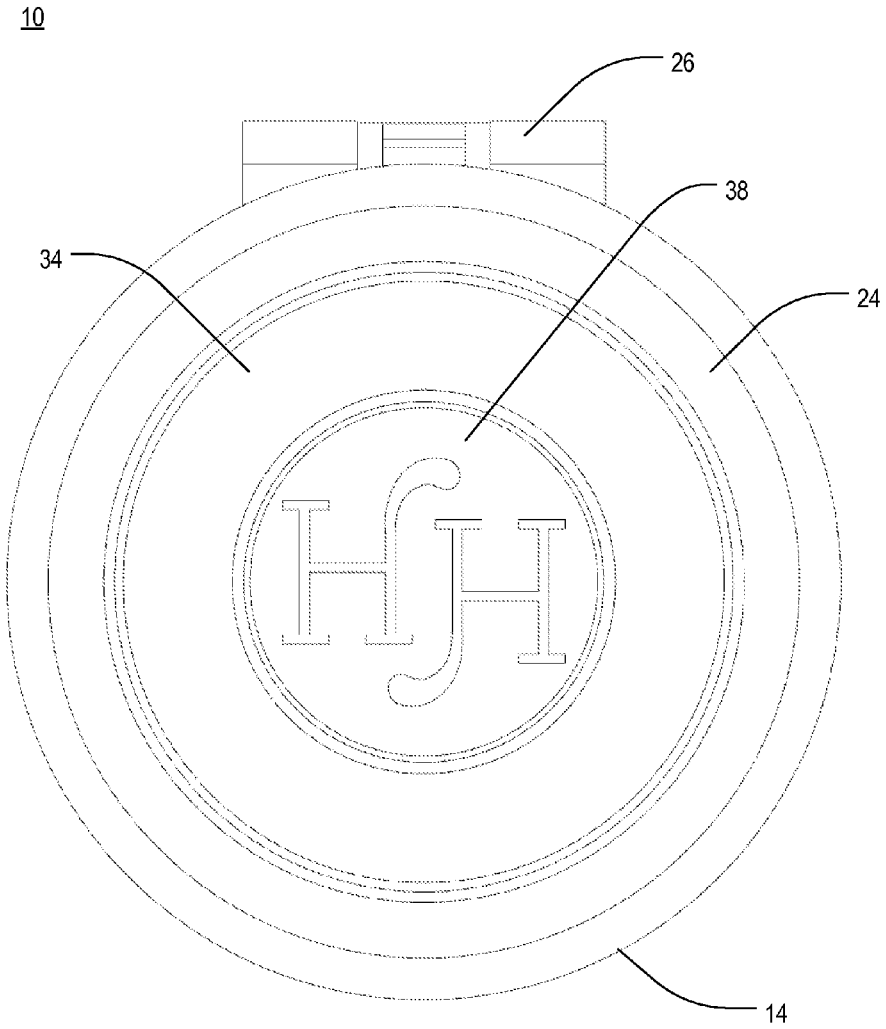
FIG. 3 is a bottom view of the color applicator of FIG. 1.

FIGS. 2 and 3 are top and bottom views, respectively, of the color applicator 10 of FIG. 1. As can be seen in FIGS. 2 and 3, each of the upper and lower halves 12,14 of the color applicator 10 has a rigid outer cap 36,38 connected to the outer perimeter 22,24 by a resilient flexible connector 32,34 that fully surrounds the outer cap 36,38. FIG. 2 illustrates the upper half of the color applicator 10, with the outer cap 36 fully surrounded by the flexible connector 32. Likewise, FIG. 3 illustrates the lower half 14 of the color applicator 10, with the outer cap 38 fully surrounded by the flexible connector 34. The outer caps 36,38 of the upper and lower halves 12,14 can be marked with stylistic markings or a desired logo.

Figure 4:
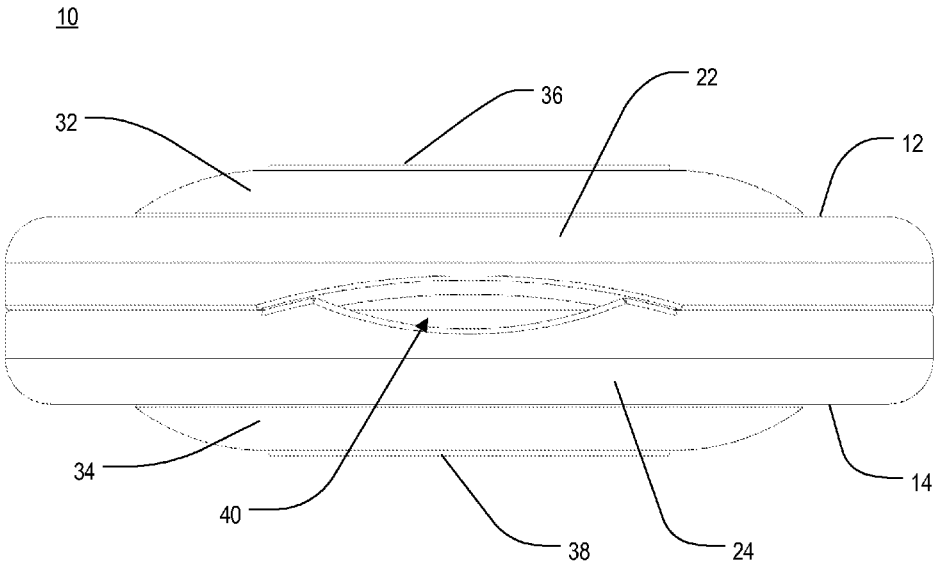
FIG. 4 is a front view of the color applicator of FIG. 1.
Figure 5:
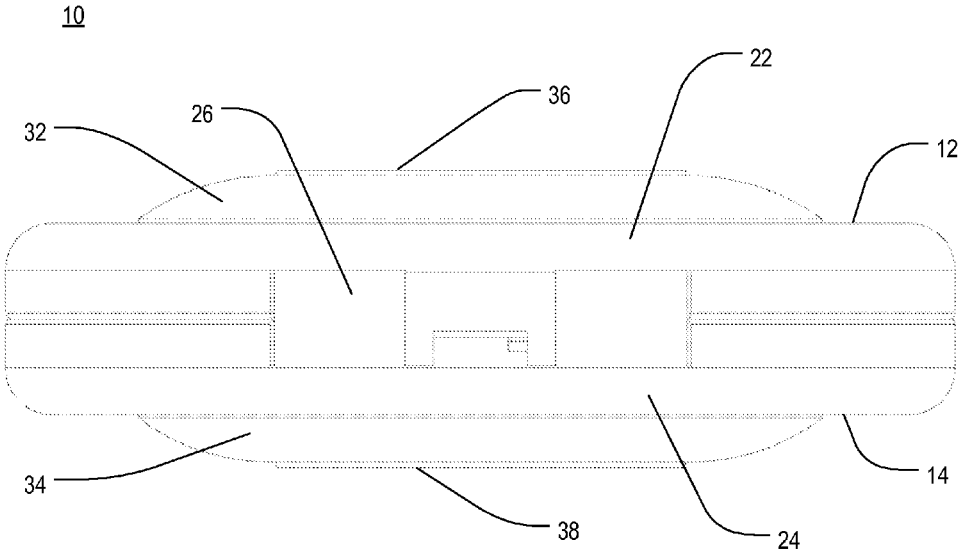
FIG. 5 is a rear view of the color applicator of FIG. 1.
Figure 6:
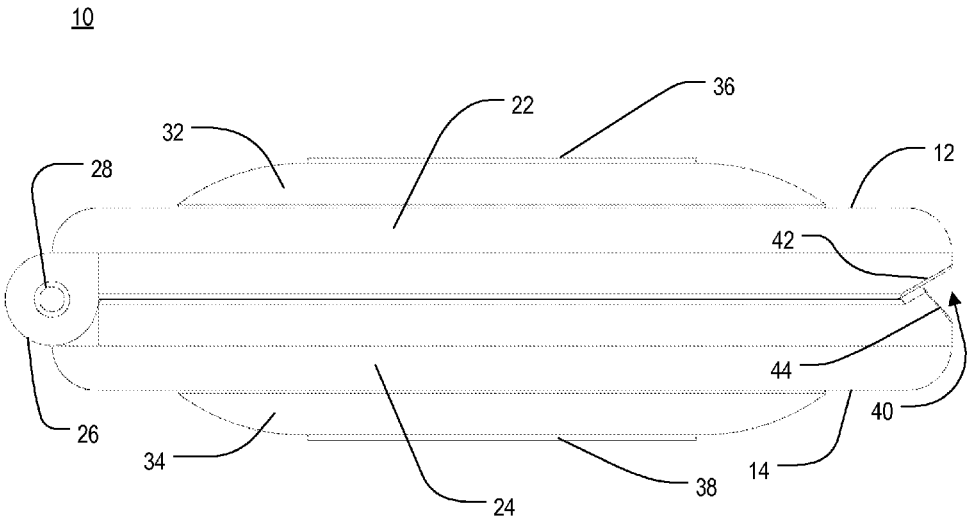
FIG. 6 is a left side view of the color applicator of FIG. 1.
Figure 7:
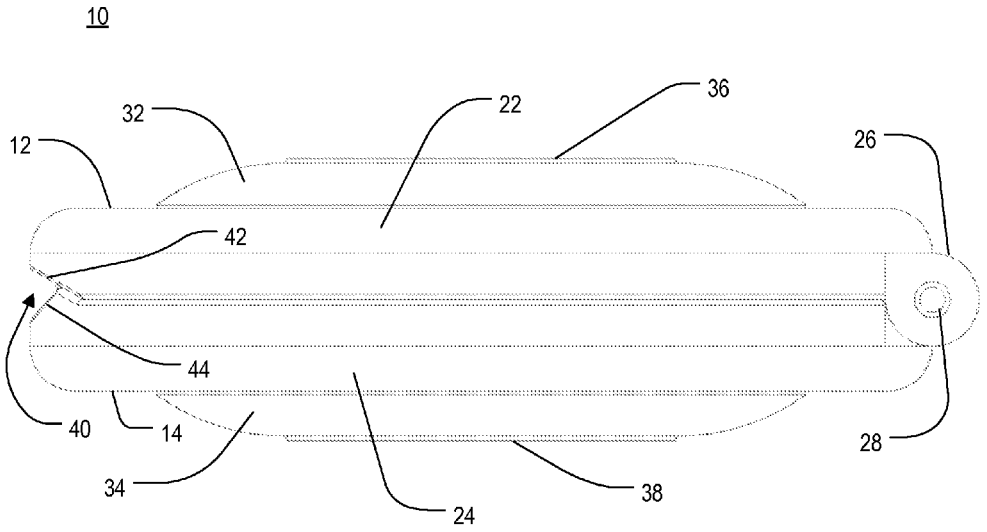
FIG. 7 is a right side view of the color applicator of FIG. 1.

FIGS. 4 and 5 are front and rear views, respectively, of the color applicator 10 of FIG. 1, and FIGS. 6 and 7 are left side and right side views, respectively, of the color applicator 10 of FIG. 1. While the perimeters 22,24 and outer caps 36,38 of the upper and lower halves 12,14 are formed of a rigid material, the flexible connectors 32,34 are formed of a resilient flexible material, such as a rubber material. In this manner, the outer caps 36,38 can be compressed inwardly toward one another when an inward pressure is applied thereto. When the inward pressure is removed, the resilient flexible connectors 32,34 return the outer caps 36,38 to their original position. As can be seen in FIGS. 4-7, the flexible connectors 32,34 extend above the perimeters 22,24 of the upper and lower halves 12,14 when viewed from the side.

As can further be seen in FIG. 4, the gap 40 is sufficiently wide so as to accommodate the tip of a user's finger. In this manner, the upper and lower halves 22,24 of the color applicator 10 can be separated from one another and pivoted about the hinge 26, thereby permitting access to the interior of the color applicator 10. Indentations 42,44 in the upper and lower halves 12,14 (perhaps best seen in FIGS. 6 and 7) are aligned with one another when the color applicator 10 is closed and thereby define the gap 40.

Figure 8:
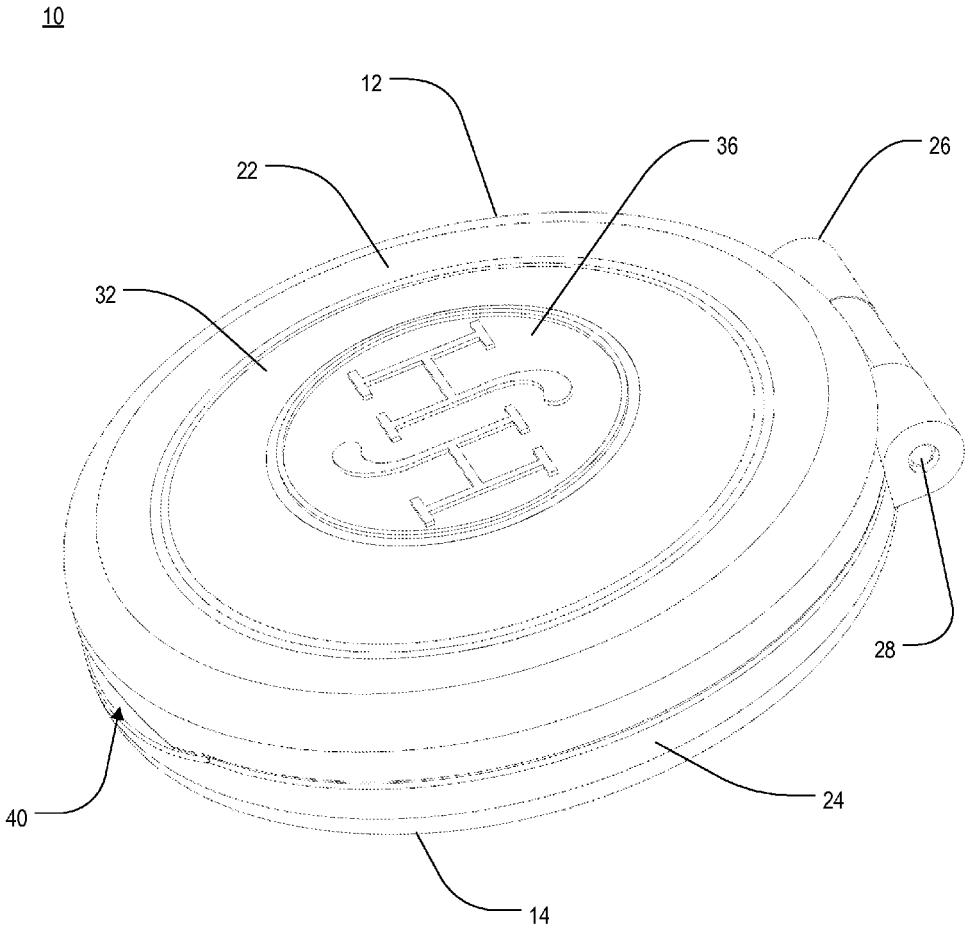
FIG. 8 is a side perspective view of the color applicator of FIG. 1.
Figure 9:
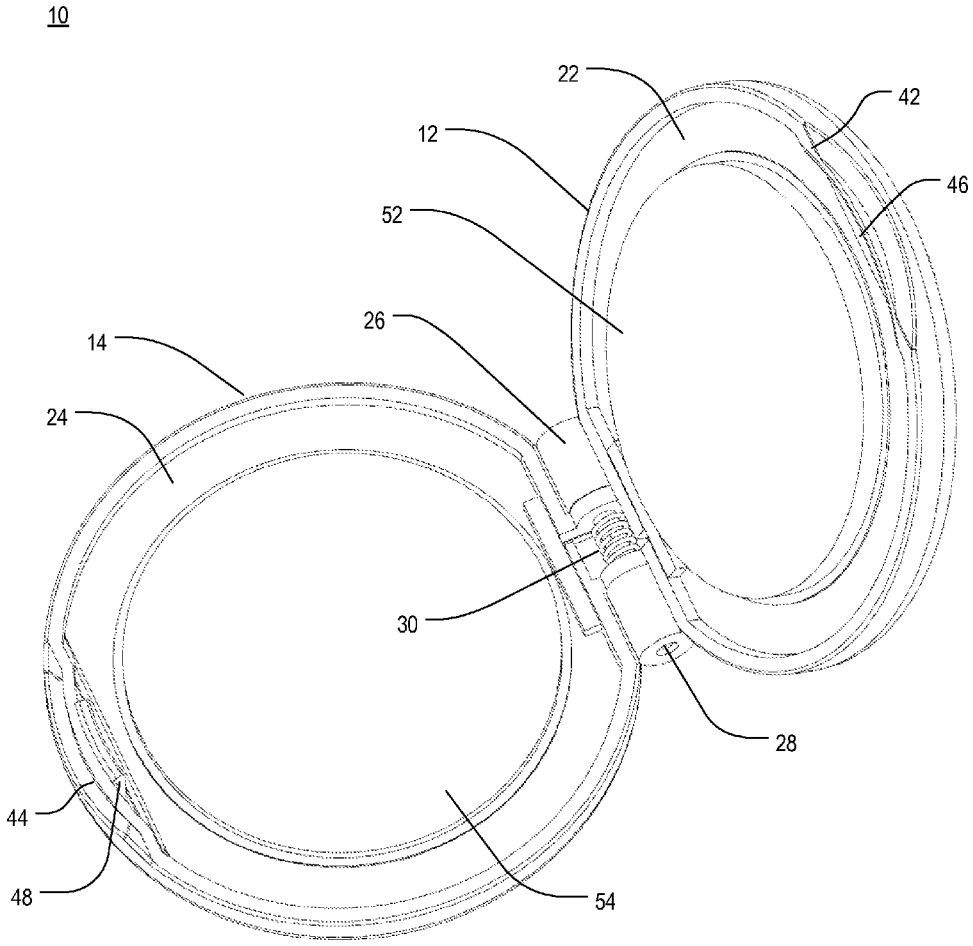
FIG. 9 is a perspective view of the color applicator of FIG. 1, shown in an open configuration.

FIG. 8 is a side perspective view of the color applicator 10 of FIG. 1. FIG. 9 is a perspective view of the color applicator 10 of FIG. 1, shown in an open configuration. As shown in FIG. 9, the interior of the color applicator 10 accommodates an applicator pad 52 and a coloring material 54. In particular, the interior of the upper half 12 accommodates the applicator pad 52, which rests on an interior surface within the upper half 12. The interior of the lower half 14 accommodates the coloring material 54, which may be arranged in a tin or a small, open container. The applicator pad 52 and the coloring material 54 are arranged within the upper and lower halves 12,14 so as to engage one another when an inward pressure is applied to the outer caps 36,38 when the color applicator 10 is closed.

The applicator pad 52 may be formed of a wide range of different materials. In one contemplated embodiment, the applicator pad 52 is a sponge. The applicator pad 52 is capable of being washed and rinsed to remove excess coloring material 54 or to prepare the applicator pad 52 for use with a different color of coloring material 54.

The coloring material 54 may be any of a wide range of materials that highlight or impart color to a user's hair. In a contemplated embodiment, the coloring material 54 is a chalk material that is safe and non-toxic. The chalk material can be easily applied to a user's hair when placed into contact therewith, and the chalk material can be removed from a user's hair by washing and rinsing the user's hair with water. When the chalk material is stored in a tin or a small, open container with a rigid base, the chalk material is less likely to be broken accidentally when the color applicator 10 is in use.

The coloring material 54 may be any of a wide range of different colors or mixes of colors. In contemplated embodiments, the coloring material 54 may include, but is not limited to, green, pink, fuchsia, red, blue or cyan. It is further contemplated that the color of the flexible connectors 32,34 can be color-coded with the color of the coloring material 54 contained within the color applicator 10. In this manner, a user can easily identify the color of the coloring material 54 in a particularly color applicator 10 without needing to open the color applicator 10.

Though it is shown that the upper half 12 of the color applicator 10 contains the applicator pad 52 and the lower half 14 of the color applicator 10 contains the coloring material 54, it is contemplated that the opposite arrangement may also be implemented. In other words, it is further contemplated that the upper half 12 of the color applicator 10 contains the coloring material 54 and the lower half 14 of the color applicator 10 contains the applicator pad 52.

As further shown in FIGS. 8 and 9, the hinge 26 that attaches the upper and lower halves 12,14 together includes an axle 28 with a spring 30 mounted thereon. Ends of the spring 30 are inserted into the upper and lower halves 12,14 so that the color applicator 10 is biased against being in a closed configuration. The spring 30 is housed largely inside the hinge 26 so that the spring 30 is unlikely to accidentally entangle a user's hair during use.

Additionally, the lower half 14 of the color applicator 10 includes a hooked portion 48 that corresponds with an edge 46 of the upper half 12 of the color applicator 10. When the upper and lower halves 12, 14 are brought together to close the color applicator 10, the hooked portion 48 of the lower half 14 engages and clasps the edge 46 of the upper half 12, thereby clasping the upper and lower halves together in the closed configuration. The hooked portion 48 and edge 46 are arranged at the indentations 42,44 so as to provide a user with access to unclasp the upper and lower halves 12,14. When the hooked portion 48 of the lower half 14 is unclasped from the edge 46 of the upper half 12, the spring 30 causes the upper and lower halves 12,14 to spring apart from one another, thereby shifting the color applicator 10 from the closed configuration to an open configuration.

Figure 10:
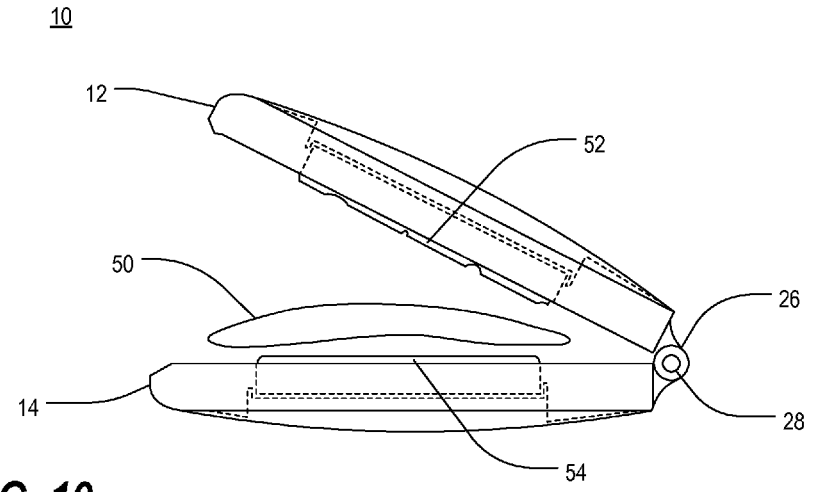
FIG. 10 is a side schematic view of the color applicator of FIG. 1, shown with strands of a user's hair positioned between upper and lower halves of the color applicator.
Figure 11:
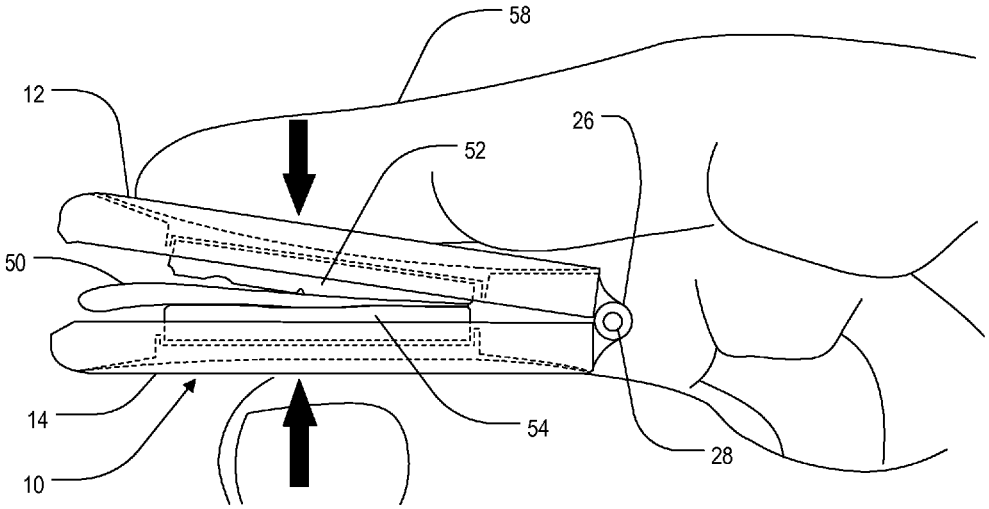
FIG. 11 is a side schematic view of the color applicator of FIG. 1, shown with a user's hand clamping the user's hair between the upper and lower halves of the color applicator.

FIG. 10 is a side schematic view of the color applicator 10 of FIG. 1, shown with strands of a user's hair 50 positioned between upper and lower halves 12,14 of the color applicator 10. FIG. 11 is a side schematic view of the color applicator 10 of FIG. 1, shown with a user's hand 58 clamping the user's hair 50 between the upper and lower halves 12,14 of the color applicator 10. FIGS. 10 and 11 depict a method of using a color applicator 10 in accordance with one or more embodiments of the present invention. In particular, it is shown in FIG. 10 that a user's hair 50 can be arranged between the upper and lower halves 12,14 when the upper and lower halves 12,14 are pivoted away from one another about the hinge 26. When a user uses his or her hand 58 to apply an inward pressure on the outer caps 36,38, against the bias of the spring 30, the upper and lower halves 12,14 are pivoted toward one another about the hinge 26. While not required, the user can pivot the upper and lower halves 12,14 fully against one another so that the hooked portion 48 of the lower half 14 engages and clasps the edge 46 of the upper half 12, thereby clasping the upper and lower halves 12,14 together.

The flexible connectors 32,34 permit the outer caps 36,38 to be pressed against the applicator pad 52 and the coloring material 54 contained within the color applicator 10. In this manner, the user's hair 50 is effectively clamped between the upper and lower halves 12,14 of the color applicator 10 and, in particular, between the applicator pad 52 and the coloring material 54. The user can then pull the color applicator 10 along the strands of the user's hair 50 clamped in the color applicator 10. As the user's hair is compressed between the applicator pad 52 and the coloring material 54, the applicator pad 52 applies color from the coloring material 54 to the user's hair 50. Once pulled through the color applicator 10, the user's hair 50 is left with a streak of highlights or color imparted by the coloring material 54. Once the inward pressure is removed, the flexible connectors 32,34 return to their original position. Furthermore, if the color applicator 10 has not been clasped in the closed configuration, the color applicator 10 can automatically spring open to release the user's hair 50 once the inward pressure is removed.

Figure 12:
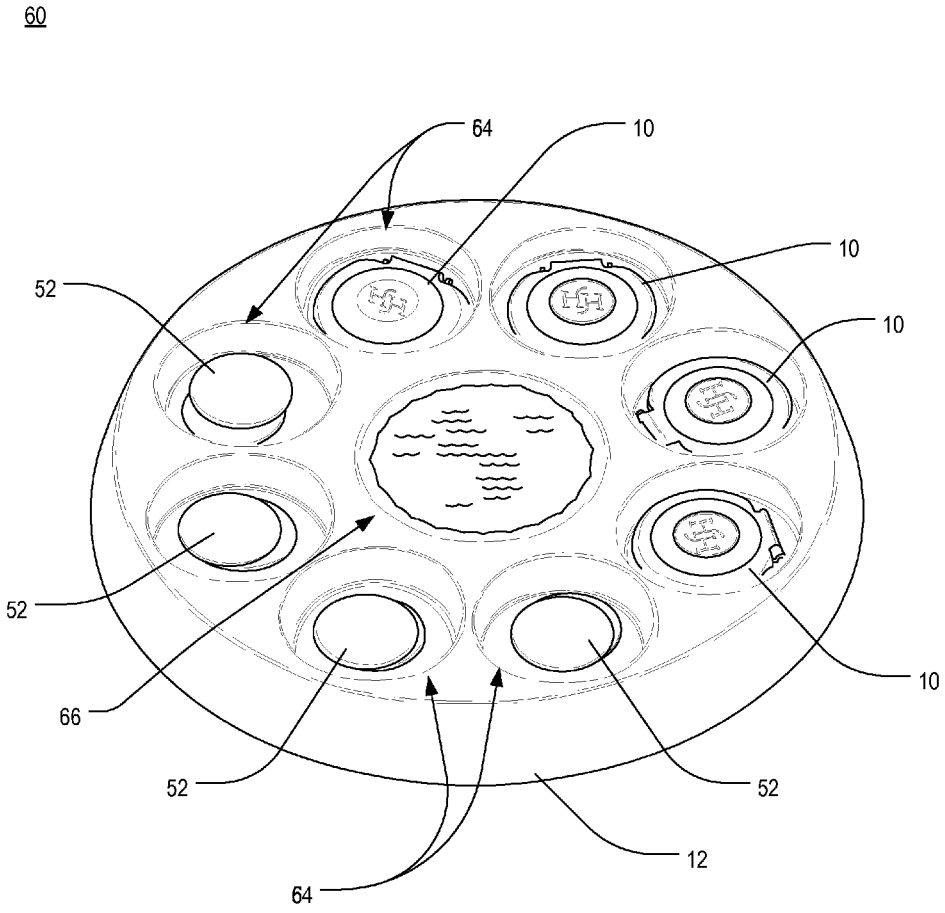
FIG. 12 is a perspective view of a tray for containing a plurality of color applicators in accordance with one or more preferred embodiments of the present invention.

FIG. 12 is a perspective view of a tray 60 for containing a plurality of color applicators 10 in accordance with one or more preferred embodiments of the present invention. As shown in FIG. 12, the tray 60 includes a plurality of wells 64, each generally sized to accommodate a color applicator 10. While the tray 60 may include any desired quantity of wells 64, the tray 60 in one contemplated embodiment includes eight wells 64. The wells 64 may also be used to accommodate extra applicator pads 52 that can be used to replace worn applicator pads 52 used in the color applicators 10. The tray 60 further includes a central reservoir 66 that can contain a liquid substance, such as water, for washing applicator pads 52 of the color applicators 10.

Figure 13:
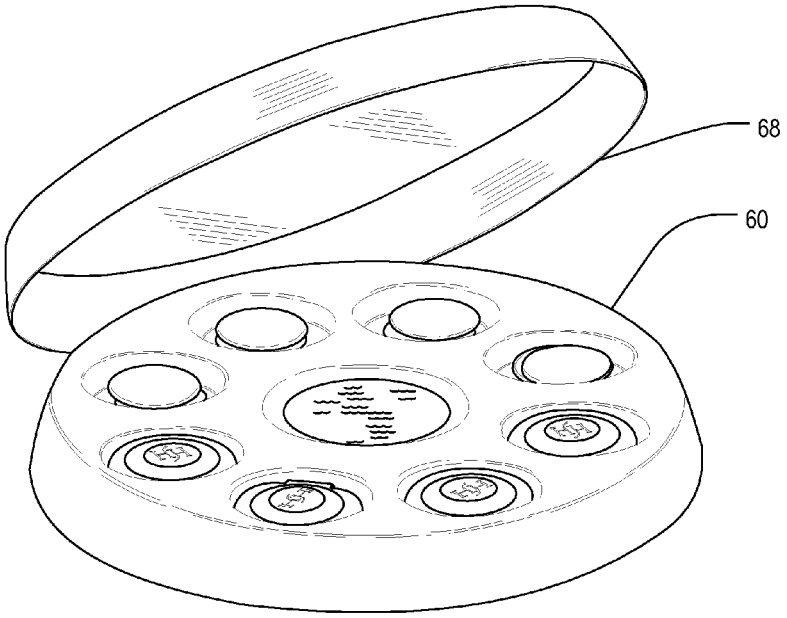
FIGS. 13 and 14 are perspective views of the tray of FIG. 12 and a lid for covering the tray.
Figure 14:
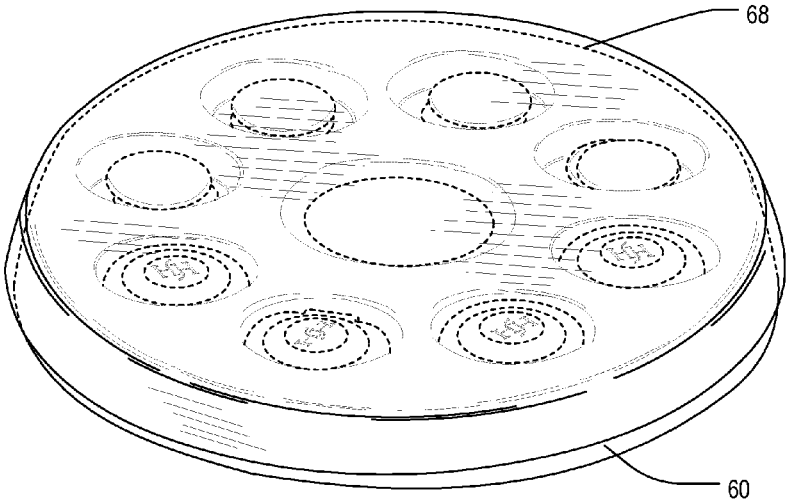

FIGS. 13 and 14 are perspective views of the tray 60 of FIG. 12 and a lid 68 for covering the tray 60. The lid 68 is sized to fit over and generally cover the tray 60, thereby protecting the contents of the tray 60 during storage or helping to prevent spilling the contents of the tray 60. The lid 68 can be formed of a transparent material so as to permit a user to view the contents of the tray 60. In one contemplated embodiment, the tray 60 and the lid 68 are each formed of a plastic material and are formed by a vacuum forming or a thermoforming process.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. A cosmetic applicator for highlighting or imparting color to a user's hair, the applicator comprising:

(a) upper and lower halves attached together by a hinge, each half including a rigid outer cap and a flexible connector surrounding and connecting the outer cap to a perimeter of the respective half;

(b) an applicator pad arranged in an interior of one of the upper and lower halves; and (c) a coloring material arranged in an interior of the other of the upper and lower halves;

(d) wherein the flexible connectors permit the outer caps of the respective upper and lower halves to be pressed inwardly toward one another so as to bring the applicator pad and the coloring material into engagement with one another.

2. The cosmetic applicator of claim 1, wherein the coloring material includes a chalk material.

3. The cosmetic applicator of claim 1, wherein the applicator pad is a sponge.

4. The cosmetic applicator of claim 1, wherein the coloring material includes at least one of the following colors: green, pink, fuchsia, red, blue and cyan.

5. The cosmetic applicator of claim 1, wherein the color of the flexible connectors is color-coded with the color of the coloring material.

6. The cosmetic applicator of claim 1, wherein one of the upper and lower halves includes a hooked portion to clasp-ingly engage with an edge of the other of the upper and lower halves, thereby facilitating clasping of the upper and lower halves together.

7. The cosmetic applicator of claim 6, wherein the hinge includes a spring for biasing the upper and lower halves against arrangement in a closed configuration such that, when unclasped, the upper and lower halves spring apart.

8. A kit for coloring hair, the kit comprising:

(a) one or more color applicators, each color applicator including upper and lower halves attached together by a hinge, and each of the upper and lower halves including a rigid outer cap and a flexible connector surrounding and connecting the outer cap to a perimeter of the respective half wherein each color applicator includes an applicator pad arranged in an interior of one of the upper and lower halves and a coloring material arranged in an interior of the other of the upper and lower halves, wherein the flexible connectors permit the outer caps of the respective upper and lower halves to be pressed inwardly toward one another so as to bring the applicator pad and the coloring material into engagement with one another; and (b) a tray for housing the one or more color applicators.

9. The kit of claim 8, wherein the coloring material of each of the one or more color applicators includes a chalk material.

10. The kit of claim 8, wherein the applicator pad of each of the one or more color applicators is a sponge.

11. The kit of claim 8, wherein the color of the flexible connectors of each of the one or more color applicators is color-coded with the color of the coloring material contained within each of the one or more color applicators.

12. The kit of claim 8, wherein the one or more color applicators includes a plurality of color applicators, each having a coloring material of a different color.

13. The kit of claim 8, wherein one of the upper and lower halves includes a hooked portion to claspingly engage with an edge of the other of the upper and lower halves, thereby facilitating clasping of the upper and lower halves together.

14. The kit of claim 13, wherein the hinge includes a spring for biasing the upper and lower halves against arrangement in a closed configuration such that, when unclasped, the upper and lower halves spring apart.

15. The kit of claim 8, further comprising a lid for covering the tray.

16. The kit of claim 15, wherein the lid is transparent to permit viewing of the contents of the tray.

17. The kit of claim 8, wherein the tray includes a plurality of wells, each well being sized to surround one of the one or more color applicators.

18. The kit of claim 17, wherein each well is sized to snugly retain one of the one or more color applicators.

19. The kit of claim 8, wherein the tray includes a central reservoir for containing a liquid substance for washing applicator pads of the one or more color applicators.

* * * * *